United States Patent [19]

Reiter

[11] Patent Number: 4,779,385

[45] Date of Patent: Oct. 25, 1988

[54] GYPSUM BOARD SANDING APPARATUS

[76] Inventor: John P. Reiter, 10407 Quebec Ave. South, Bloomington, Minn. 55438

[21] Appl. No.: 41,471

[22] Filed: Apr. 23, 1987

[51] Int. Cl.[4] ..... B24B 23/00

[52] U.S. Cl. ..... 51/180; 51/273

[58] Field of Search ..... 51/180, 170 TL, 170 R, 51/273

[56] References Cited

U.S. PATENT DOCUMENTS 3,826,045 7/1974 Champayne ..... 51/273

4,062,152 12/1977 Mehrer ..... 51/273

FOREIGN PATENT DOCUMENTS 3413028 10/1985 Fed. Rep. of Germany ..... 51/273

*Primary Examiner*—Roscoe V. Parker

*Attorney, Agent, or Firm*—Orrin M. Haugen; Thomas J. Nikolai; Frederick W. Niebuhr

[57] ABSTRACT

A gypsum board sanding device which is adapted to be coupled to a vacuum cleaner for significantly reducing the dust problem created when sanding the joint cement. A sanding paddle is provided which is adapted to support a sheet of sandpaper, the paddle having a plurality of pedestals defining air passages between the non-abrasive side of the sandpaper and the base from which the pedestals project. A hollow tubular handle is joined to the paddle with the interior opening of the handle communicating with a hole formed through the thickness dimension of the paddle. Means are provided for fastening a conventional vacuum cleaner to the handle whereby dust and other debris generated during the sanding operation is drawn from the periphery of the sanding paddle into a dust collection reservoir.

3 Claims, 2 Drawing Sheets

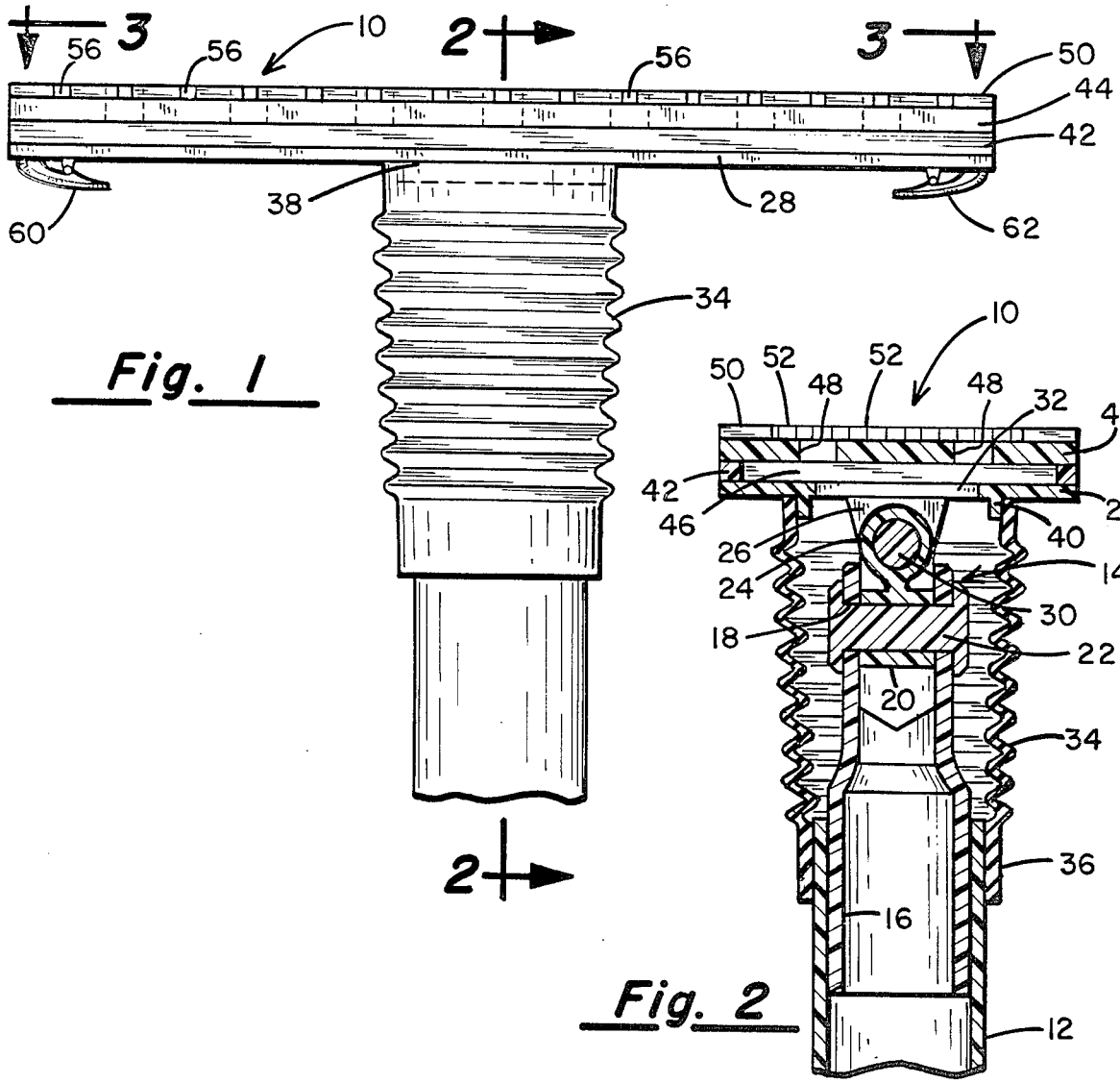
Fig. 1
Fig. 2
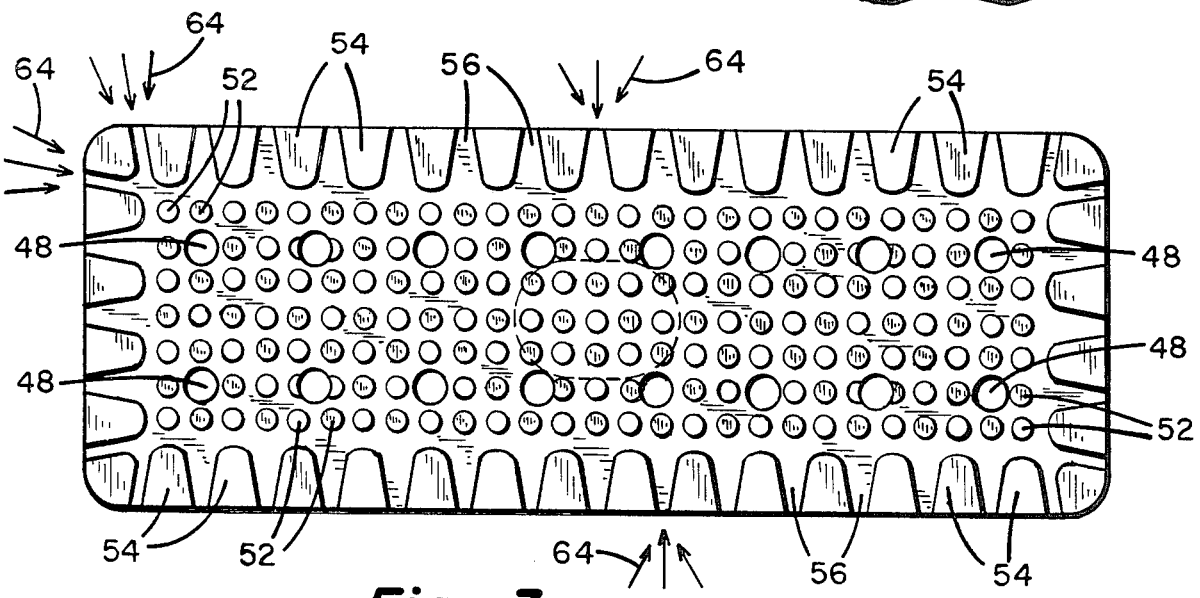
Fig. 3

GYPSUM BOARD SANDING APPARATUS

BACKGROUND OF THE INVENTION

I. Field of the Invention:

This invention relates generally to an improved device for creating smooth joints between sheets of gypsum type wallboard, and more particularly to an improved gypsum board sanding tool incorporating a dust collecting feature.

II. Discussion of the Prior Art:

In joining adjacent sheets of gypsum wallboard to form a smooth continuous appearance to the wall, the practice in the past has been to apply a tape to the seam and then cover that tape with several layers of joint cement, with each layer being feathered out a greater distance from the seam. Once the joint cement or plaster is so applied, it is necessary to then sand the seam with a fine sand paper to remove any irregularities which might have been caused by the trolling tool.

The sanding operation in the past has been quite messy. The fine dust particles created during the sanding operation can be drawn into the building's heating system and spread throughout the building's interior requiring extensive clean-up efforts.

Still in accordance with the prior art, the commonly used sanding tool comprised a planar paddle, typically having a handle on one side thereof and a foam rubber pad on the other. Stretched across the foam rubber pad would be a piece of replaceable sandpaper. The function of the foam pad is to limit slipping between the paper surface of the sandpaper and the paddle to which it is attached. It is also known to couple a paddle to an elongated wooden or metal handle by means of a universal joint so that seams between gypsum board panels on a ceiling surface can be reached from the floor. The U-joint allows the face of the sanding tool to remain in parallel contact with the wall or ceiling surface being sanded as the handle is pushed back and forth in a sanding stroke.

SUMMARY OF THE INVENTION

In accordance with the present invention, a new and improved sanding tool is provided for treating the joints between gypsum board panels in a fashion that significantly reduces and practically eliminates the dust problem attendant with prior art tools of the type described. In accordance with the present invention, there is provided a flat, planar paddle member which is used to support a sheet of sandpaper and which allows a suction means, such as a vacuum cleaner, to be coupled to it for producing a negative pressure around the periphery of the paddle whereby debris generated during the sanding operation is collected. In implementing the device, a generally planar base member having a hole formed through its thickness dimension and a hollow handle secured thereto, with the interior of that handle communicating with the hole, also has a planar air distribution member mounted on the flat surface thereof in such a way that a vacuum plenum is created between the base member and the air distribution member. Secured to the otherwise exposed flat surface of the air distribution member are a large plurality of raised pedestals of equal height, and arranged such that the spacing between pedestals defines a large plurality of interconnected channels extending from the periphery of the composite sanding head and leading to a series of holes which extend through the air distribution member.

When a rectangular sheet of sandpaper is then mounted on the tool, the non-abrasive surface of the sandpaper is supported by the pedestal tops and when a suction is applied to the hollow handle member by way of a vacuum cleaner or the like, dust particles generated during the sanding operation are drawn through the channels and holes into the plenum chamber and from there through the base and handle and into the dust collection bag of the vacuum cleaner.

OBJECTS

It is accordingly a principal object of the invention to provide a new and improved sanding tool for use in sanding the seam or joints between adjacent gypsum board panels.

Another object of the invention is to provide a gypsum board joint sanding tool which minimizes the spread of dust normally created during a sanding operation.

Still another object of the invention is to provide an improved gypsum board sanding tool which can readily be coupled to a vacuum cleaner and which includes a means for creating a negative pressure around the entire periphery of the sandpaper surface for collecting dust particles liberated during the sanding operation.

Yet another object of the invention is to provide an improved tool for use in sanding the seams between adjacent gypsum board panels which remains flexible and easy to use in spite of being coupled through a vacuum cleaner hose to a vacuum cleaner.

These and other objects and advantages of the invention will become apparent to those skilled in the art from the following detailed description of the preferred embodiment especially when considered in conjunction with the accompanying drawings in which like numerals in the several views refer to corresponding parts.

DESCRIPTION OF THE DRAWINGS

FIG. 1 is a partial side elevation of a first embodiment of the invention.

FIG. 2 is a cross-sectional view of the device of FIG. 1 taken along the line 2—2 in FIG. 1.

FIG. 3 is a view of the sandpaper supporting head of the present invention taken along the lines 3—3 in FIG. 2.

DESCRIPTION OF THE PREFERRED EMBODIMENT

Figure 4:
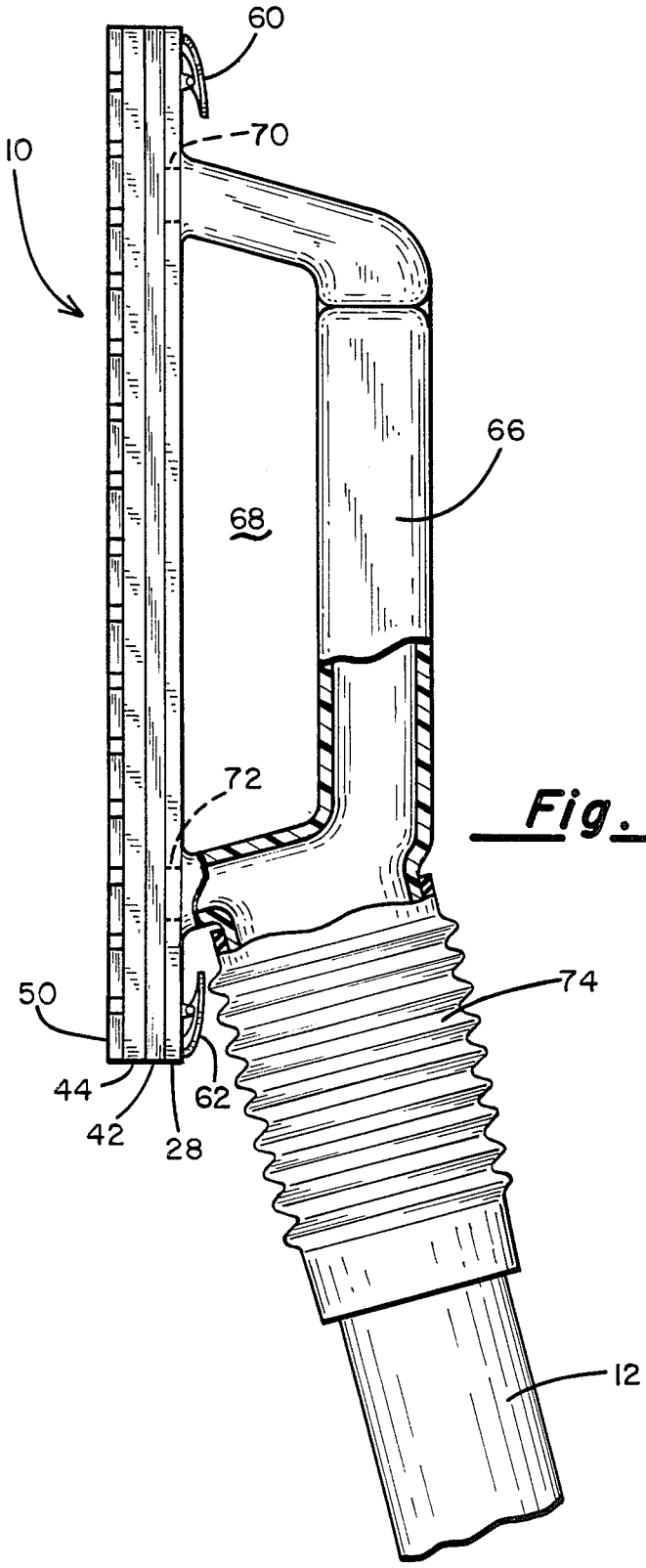
FIG. 4 illustrates by means of a partially sectioned side view a further embodiment of the present invention.

Referring first to FIGS. 1 and 2, it can be seen that in accordance with one embodiment of the invention, the improved gypsum board sanding tool comprises a sandpaper supporting head indicated generally by numeral 10 which is fastened to an elongated tubular pole 12 by means of a universal joint 14. More particularly, and as can best be seen in the cross-sectional view of FIG. 2, fitted within the tube 12 is a hollow tubular stem 16 having a bore 18 formed through opposed side walls thereof. Positioned in alignment with the bore 18 is a tubular insert 20 and a pin or rivet 22 extends through both the bore 18 in the tubular stub 16 and the insert 20, allowing limited rotation of the insert 20 about the pin 22. Integrally formed with the insert 20 is a further tubular extension 24, the bore of which is at right angles to the bore extending through the insert 20. The tubular extension 24 is arranged to fit between spaced apart ears 26 affixed to a generally planar base member 28. A pin 30 extends through both the ears 26 and the tubular member 24 to allow rotation of the base member 28 about the axis of the pin 30.

With continued reference to FIGS. 1 and 2, it can be seen that an opening 32 is formed through the thickness dimension of the base member 28 and a flexible, accordion pleated boot 34 surrounds the U-joint connection between the handle 12 and the base member 28. One end 36 of the boot 34 is adhesively bonded or at least elastically secured to the outside surface of the elongated handle 12. Likewise, the other end 38 of the boot surrounds and is sealed to an annular flange 40 which projects downwardly from the surface of the base member 28.

Attached to the other surface of the base member 28 is a rectangular spacer 42 which surrounds the perimeter of the base plate 28. The spacer 42 may be integrally formed or, as illustrated in the drawings, may be a separate rectangular ring suitably affixed to either the base member 28 or to a planar air distribution member 44. The combination of the base 28, the spacer 42 and the air distribution member 44 creates a plenum chamber 46 in the interior of the sandpaper supporting head 10. As can further be seen in FIG. 2, the air distribution member 44 generally comprises a flat plate formed from metal or plastic and through the thickness dimension thereof is formed a hole pattern as at 48.

Bonded to the opposite flat planar surface of the air distribution member 44 is a layer 50 comprising a pattern of pedestals 52 arranged in rows and columns which are distributed over the major surface of the member 44. In addition to the circular pedestals 52, there is provided around the perimeter of the air distribution layer 44 a pattern of spaced wedge-shaped pedestals 54 which define grooves or channels 56 therebetween.

From what has been thus far described, it can be seen that when a suction is applied to the tubular handle 12 as by connecting it to a vacuum cleaner, air will be drawn from the perimeter of the head 10 through the channels 56 between the wedge-shaped pedestals 54 and through the channels defined by the spaced circular pedestals 52 and through the holes in the air distribution member 44 and into the plenum 46. From there, the air will flow through the opening 32 in the base member 28 and, thence, through and about the tubular U-joint coupling. The boot 34 provides a seal about this coupling preventing the intake of air except from and around the working face of the tool.

While not shown in FIGS. 1–3, a strip of sandpaper of a desired grit may be clamped at one end thereof by means of a spring-loaded clamp 60, wrapped over the working surface of the head 10, and then the free end thereof can be clamped by a similar spring-loaded clamp 62. It is also contemplated that adhesive-backed sandpaper can be directly affixed to the top surfaces of the pedestals 52 and 54.

When in use, the sandpaper serves as a cover for the channels formed between the projecting pedestals and, hence, principal air flow will be from the area around the side edge surfaces of the tool as indicated by the flow arrows 64 so that as dust particles are created during the sanding strokes, those particles will be drawn along the above-described air flow path and into the vacuum canister. It has also been found desirable to form holes through the sandpaper layer more central of the perimeter so as to also allow the plaster dust to pass through the sandpaper and into the vacuum plenum 46 portion of the head.

FIG. 4 illustrates an alternative embodiment of the invention. While the embodiment of FIGS. 1–3 is intended to be used at the end of a long handle so that high places on the walls and ceilings can be reached from the floor without the user having to wear stilts, the tool shown in FIG. 4 can be used in easy-to-reach locations.

Like the previous embodiment, it comprises a base member 28 having a spacer 42 and an air distribution member 44 and a pedestal layer 50 secured thereto, it also includes a hollow U-shaped handle 66 which may be readily gripped with the worker's fingers looping through the opening 68 between the handle 66 and the base member 28. The handle 66 is integrally formed with or suitably bonded to the exposed upper surface of the base member 28 and is made to surround openings 70 and 72 formed through the thickness dimension of the plate 28. A flexible boot 74 is used to couple the pipe 12 to the hollow handle 66 so that limited angular movement of the sanding tool relative to the connecting hose or pipe 12 is allowed. When it is understood that the openings or holes 70 communicate with the vacuum plenum 46 interior to the tool head 10, it can be readily perceived how the dust particles created during the sanding operation will be drawn from the wall surface, through the various channels in the pedestal layer 50, through the air distribution member 44 and through the hollow handle 66 to the vacuum canister via the couplings 74 and the hose 12.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to equipment details and operating procedures, can be accomplished without departing from the scope of the invention itself.

I claim:

1. A hand sanding apparatus for use in drywall joint finishing comprising:

(a) a generally rectangular planar base member having first and second holes formed through the thickness dimension thereof at spaced apart locations:

(b) a hollow, generally U-shaped, handle member secured to one side of said base member and dimensioned to be grasped in one hand, the interior of said hollow handle member being in fluid communication with both of said first and second holes in said base member;

(c) a first, generally planar, rigid air distribution member having a pattern of apertures extending through the thickness dimension thereof;

(d) a rectangular spacer member having a generally rectangular opening formed therethrough, said spacer being disposed between the other side of said base member and one side of said first air distribution member, said spacer surrounding said pattern of apertures;

(e) a plurality of raised pedestals of equal height extending outwardly from the surface of said air distribution member to define interconnected channels leading from the periphery of said air distribution member to said pattern of apertures, said pedestals adapted to support a perforated sheet of sandpaper mounted thereon and said hollow handle adapted to be operatively coupled to a vacuum source.

2. The gypsum board joint sanding apparatus as in claim 1 and further including means for fastening a sheet of sandpaper across said plurality of pedestals.

3. The gypsum board joint sanding apparatus as in claim 2 wherein said means for fastening comprises spring loaded clamping means

* * * * *